US006247614B1

(12) United States Patent
Whitney et al.

(10) Patent No.: US 6,247,614 B1
(45) Date of Patent: Jun. 19, 2001

(54) METHOD AND APPARATUS FOR DISPENSING A LIQUID CONTAINING GAS IN SOLUTION

(75) Inventors: Lowell T. Whitney; Michael L. Lane, both of Arvada; Michael D. Gerstenkorn, Golden, all of CO (US)

(73) Assignee: Quoin Industrial, Inc., Golden, CO (US)

( * ) Notice: Subject to any disclaimer, the term of this patent is extended or adjusted under 35 U.S.C. 154(b) by 0 days.

(21) Appl. No.: 09/362,483

(22) Filed: Jul. 28, 1999

Related U.S. Application Data

(63) Continuation of application No. 09/473,203, filed on Jul. 15, 1999.

(51) Int. Cl.[7] ..... B67B 7/00

(52) U.S. Cl. ..... 222/1; 222/386.5; 222/564

(58) Field of Search ..... 222/386.5, 399, 222/396, 397, 564, 547, 394; 251/144, 319, 118, 127; 138/42

(56) References Cited

U.S. PATENT DOCUMENTS

| | | | | |
|---|---|---|---|---|
| 2,762,397 | | 9/1956 | Miller . | |
| 3,096,000 | * | 7/1963 | Staley | 222/1 |
| 3,718,236 | * | 2/1973 | Reyner | 222/386.5 |
| 3,762,649 | * | 10/1973 | Dalhaus | 239/391 |
| 4,135,641 | | 1/1979 | Fallon et al. | 222/1 |
| 4,739,901 | * | 4/1988 | Dorfman et al. | 222/1 |
| 4,832,968 | | 5/1989 | Forage et al. | 426/112 |
| 4,867,348 | * | 9/1989 | Dorfman | 222/172 |
| 4,919,310 | | 4/1990 | Young et al. | 222/386.5 |
| 4,923,095 | | 5/1990 | Dorfman | 222/386.5 |
| 5,333,763 | | 8/1994 | Lane et al. | 222/386.5 |
| 5,368,205 | | 11/1994 | Groh | 222/189 |
| 5,390,832 | | 2/1995 | Lombardo | 222/394 |
| 5,769,282 | | 6/1998 | Lane et al. | 222/386.5 |
| 5,823,436 | * | 10/1998 | Waldrum | 239/123 |

* cited by examiner

*Primary Examiner*—Kevin Shaver
*Assistant Examiner*—Melvin A Cartagena
(74) *Attorney, Agent, or Firm*—Klaas, Law, O'Meara & Malkin, P.C.; Michael A. Goodwin, Esq.

(57) ABSTRACT

Disclosed is a an improved dispensing system which allows nitrogenized liquids to be dispensed from a relatively low pressure dispensing system (i.e., one operating in a relatively low pressure range). To accomplish this, the improved dispensing system includes holes having very small cross-sectional areas. The improved dispensing system may be formed so as to facilitate the manufacturability of the holes required for the proper dispensing of nitrogenized liquids. For this purpose, the improved dispensing system may include a dispensing valve body and an insert member having a plurality of grooves therein. When the insert member is inserted within the valve body, the insert member grooves, along with a portion or portions of the valve body, together form the plurality of holes required for the proper dispensing of nitrogenized liquids.

24 Claims, 7 Drawing Sheets

METHOD AND APPARATUS FOR DISPENSING A LIQUID CONTAINING GAS IN SOLUTION

This application is a continuation of application Ser. No. 09/473,202 filed Jul. 15, 1999.

FIELD OF THE INVENTION

The present invention relates generally to a method and apparatus for dispensing nitrogenized liquids and, more particularly, to a method and apparatus for properly dispensing nitrogenized liquids from a relatively low pressure dispensing system.

BACKGROUND OF THE INVENTION

Carbonated beverages, such as beer, contain carbon dioxide gas which is dissolved in solution. This dissolved carbon dioxide gas affects the flavor profile of the beverage and also causes the characteristic foaming or "outgassing" during dispensing of the beverage.

Some types of beers are commonly charged with nitrogen gas in place of, or in addition to, carbon dioxide gas. Beer that has been charged with nitrogen gas in this manner is commonly referred to as "nitrogenized beer" or, more simply, "nitro beer". It is to be understood that the term "beer", as used herein, is intended to include various fermented beverages, including, but not limited to, those commonly referred to as "stout", "ale", "lager" and even "cider".

The use of nitrogen gas in beer causes the beer to display a more creamy head of foam, or froth, upon dispensing than would a beer containing only carbon dioxide gas in solution. The use of nitrogen gas also improves "lacing" which is the feature of foam coating the inside of the glass from which the beer is consumed. Both the provision of a creamy head and improved lacing are important considerations to consumers and are, therefore, of commercial importance. Typical nitro beers contain dissolved nitrogen at a concentration of at least about 30 ppm.

In order to achieve these desired effects in a nitro beer, it is necessary that the dissolved nitrogen gas be forced out of solution during dispensing, i.e., immediately prior to the time at which the beer is consumed by a consumer. This process, often referred to as gas evolution or gas liberation, occurs when a large number of relatively small gas bubbles form within the liquid beer. These gas bubbles, in turn, result in the improved froth and lacing characteristics discussed above. The use of nitrogen gas provides better froth and lacing characteristics, relative to carbon dioxide gas, because the gas bubbles liberated by dissolved nitrogen are much smaller than those liberated by dissolved carbon dioxide.

Compared to carbon dioxide, nitrogen is relatively difficult to force out of solution. Accordingly, specialized beer taps or faucets traditionally have been used for dispensing nitro beers from pressurized dispensing systems, such as those used in bars and restaurants. These specialized faucets typically include a plurality of small openings through which the beer is forced during dispensing. These holes are typically formed as cylindrical through-holes each of which may, for example, have a cross-sectional area of about 0.00062 square inch.

The pressurized dispensing system to which such a faucet is connected typically operates at a relatively high pressure, in the range of from about 30 to about 40 psi. Forcing the nitro beer through these small openings at such a relatively high pressure agitates the beer sufficiently to drive a substantial amount of nitrogen out of solution and, thus, produce the desirable characteristics described above.

In more recent years, efforts have also been made to package nitro beers in containers such as cans and bottles. In order to produce the necessary gas liberation in such containers, agitation devices have been developed which can be placed within the containers and activated upon opening of the containers. These agitation devices are commonly referred to in the industry as "smoothifiers" or "widgets". An example of such a device is described in U.S. Pat. No. 4,832,968 to Forage et al. which is hereby incorporated by reference for all that is disclosed therein.

It has been found that the specialized faucets described above will not function properly in dispensing nitro beer from a relatively low pressure dispensing system, i.e., one that operates at a pressure less than about 30 psi. Although nitro beer will dispense through the specialized faucet at this pressure, insufficient nitrogen gas is liberated and the desirable froth and lacing characteristics described above are not achieved. One type of such a relatively low pressure dispensing system is a self-contained system in which a flexible pressure pouch is immersed within a container of beer. The pressure pouch may comprise various compartments housing components of a two-part gas generating system. The pressure pouch may be configured such that, as beer is dispensed from the system, additional chemical compounds are mixed, thus causing the pressure pouch to expand and maintain the pressure within the system. Examples of such dispensing systems, and of pressure pouches used in conjunction therewith, are disclosed in U.S. Pat. No. 4,919,310 to Young et al.; U.S. Pat. No. 4,923,095 to Dorfman et al.; U.S. Pat. No. 5,333,763 to Lane et al.; U.S. Pat. No. 5,769,282 to Lane et al.; and U.S. patent application Ser. No. 09/002,406, filed Jan. 2, 1998 of Lane et al. for MULTI-COMPARTMENT POUCH HAVING A FRANGIBLE COMPARTMENT DIVIDER, which are all hereby specifically incorporated by reference for all that is disclosed therein.

Such relatively low pressure dispensing systems may operate generally within a pressure range of between about 15 and about 25 psi. As described above, conventional nitro beer faucets will not operate adequately in such a low pressure environment.

It has also been found that the small through-holes commonly used in conventional nitro beer faucets are difficult and expensive to manufacture. This is a particular problem when it is desired to dispense nitro beer from a disposable system, rather than a fixed beer dispensing faucet such as might be found in a bar or pub.

Accordingly, it would be desirable to provide a dispensing mechanism which provides for the proper dispensing of nitrogenized beverages from a relatively low-pressure dispensing system and which overcomes the manufacturability problems associated with small through holes as discussed above.

SUMMARY OF THE INVENTION

An improved dispensing system is provided which allows nitrogenized liquids to be dispensed from a relatively low pressure dispensing system. To accomplish this, the improved dispensing system includes holes, or openings, having very small cross-sectional areas, of generally less than about 0.0003 square inch. Forcing the nitrogenized liquid through these very small openings results in sufficient liberation of nitrogen gas to cause the desirable froth and lacing characteristics described previously, even when the liquid is dispensed from a relatively low pressure dispensing system.

The improved dispensing system may be formed so as to facilitate the manufacturability of the openings required for the proper dispensing of nitrogenized liquids. For this purpose, the improved dispensing system may include a dispensing valve body and an insert member having a plurality of grooves therein. When the insert member is inserted within the valve body, the insert member grooves, along with a portion or portions of the valve body, together form the plurality of openings required for the proper dispensing of nitrogenized liquids. In this manner, the need to manufacture through-holes is eliminated. This is advantageous since it is difficult and expensive to maintain a tool for forming such through-holes. The grooves in the insert member may easily be formed in any conventional manner. The grooves may, for example, be formed in the same injection molding process in which the insert member is formed.

The groove arrangement described above may advantageously be used in conjunction with any nitrogenized liquid dispensing system since it eliminates the need for through-holes which are difficult to manufacture. This groove arrangement is particularly advantageous, however, when used in conjunction with a relatively low cost, low-pressure dispensing system in which very small openings are required.

DETAILED DESCRIPTION OF THE INVENTION

Figure 1:
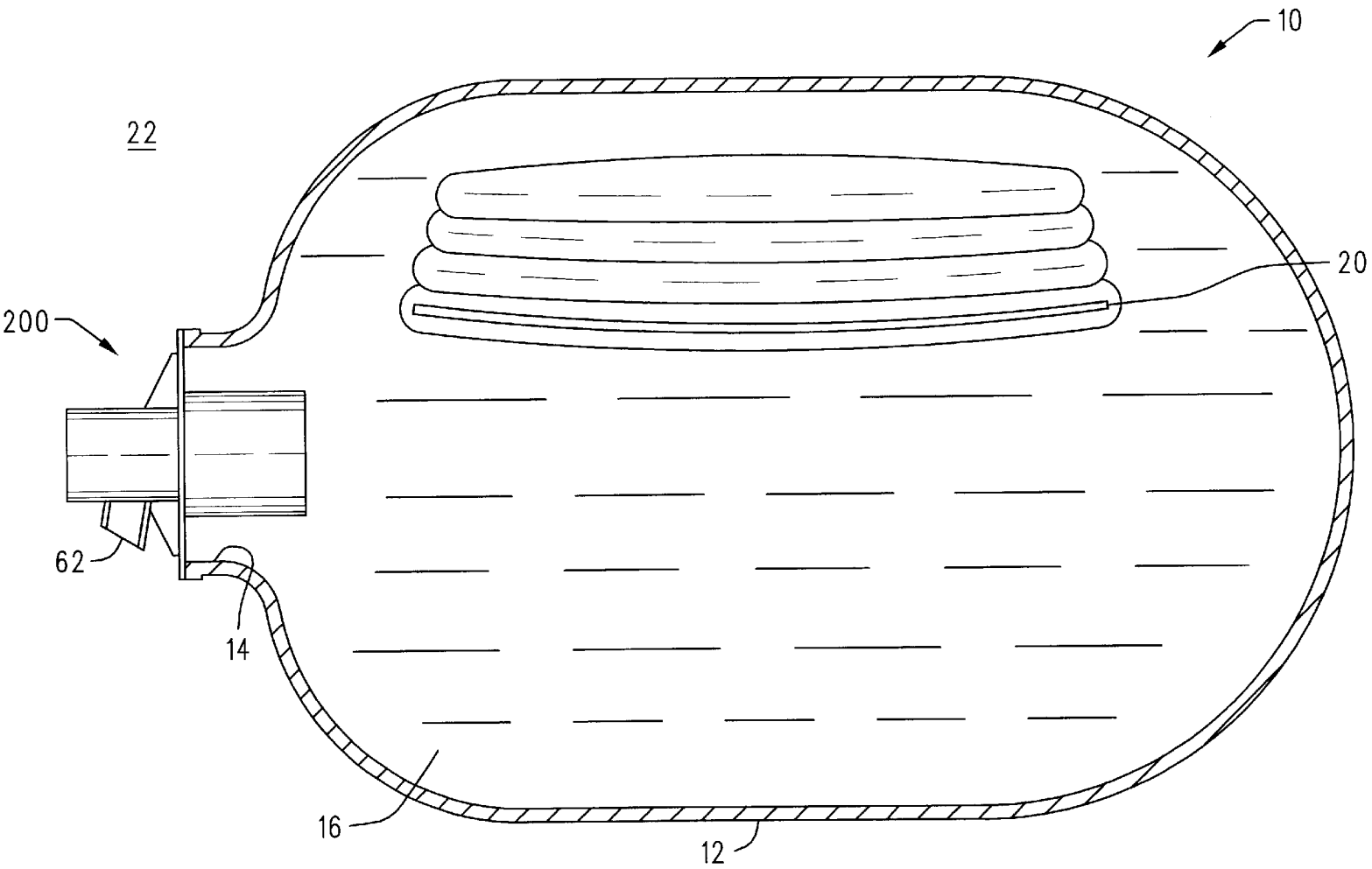
FIG. 1 is a side elevational view, in partial cross-section, of a beverage dispensing system including an improved dispensing valve assembly.

FIGS. 1 and 3–9, in general, illustrate a dispensing system 10 for dispensing a liquid 16 having a gas dissolved therein. The dispensing system 10 may include a dispensing system interior defined within the dispensing system 10 and an oppositely disposed dispensing system exterior 22 located outside of the dispensing system 10; a supply of the liquid 16 located in the dispensing system interior; a flow path extending between the supply of the liquid 16 and the dispensing system exterior 22; a plurality of openings 320 within the flow path, wherein each of the plurality of openings has a cross-sectional area of less than about 0.0003 square inch.

FIGS. 1 and 3–9 further illustrate, in general a method of dispensing a liquid 16 having a gas dissolved therein. The method includes providing a dispensing system 10 having a dispensing system interior defined within the dispensing system 10 and an oppositely disposed dispensing system exterior 22 located outside of the dispensing system 10; providing a supply of the liquid 16 within the dispensing system interior; providing a flow path extending between the supply of the liquid 16 and the dispensing system exterior 22; providing a plurality of openings 320 within the flow path, wherein each of the plurality of openings 320 has a cross-sectional area of less than about 0.0003 square inch; causing at least a portion of the gas to come out of solution by moving at least a portion of the supply of liquid 16 along the flow path and through the openings 320.

FIGS. 1 and 3–9 further illustrate, in general, a dispensing system 10 for dispensing a liquid 16 having a gas dissolved therein. The dispensing system 10 includes: a liquid flow path through the dispensing system 10; a first member 230 having a plurality of grooves 320 formed therein; a second member 40; at least a portion 286 of the first member 230 in abutting relationship with at least a portion 104 of the second member 40; a plurality of openings, each of the openings being defined at least partially by one of the plurality of grooves 320 and at least a portion 104 of the second member 40; wherein at least a portion of the liquid flow path extends through the plurality of openings 320.

FIGS. 1 and 3–9 also illustrate, in general, a method of dispensing a liquid 16 having a gas dissolved therein from a dispensing system 10. The method includes: providing the dispensing system 10 having a dispensing system interior located within the dispensing system 10 and an oppositely disposed dispensing system exterior 22 located outside of the dispensing system 10, the dispensing system exterior 22 being at an exterior pressure; providing a supply of the liquid 16 within the dispensing system interior; providing a fluid flow path extending between the supply of the liquid 16 and the dispensing system exterior 22; providing a plurality of openings 320 within the fluid flow path; applying a first pressure to the supply of liquid 16 of less than about 30 psi relative to the exterior pressure; causing at least a portion of the gas to come out of solution by moving at least a portion of the supply of liquid 16 along the fluid flow path and through the plurality of openings 320.

Having thus provided a general description, the method and apparatus will now be described in further detail.

FIG. 1 generally illustrates a beverage dispensing system 10. Beverage dispensing system 10 includes a container 12 having an opening 14. An improved dispensing valve assembly 200 may be located within and, thus, seal the opening 14. Improved dispensing valve assembly 200 may be attached to the container 12 via any conventional mechanism, for example by a conventional crimp ring, not shown. Dispensing valve assembly 200 may include a dispensing opening 62. A liquid 16 may be located within the container 12. The liquid may, for example, be a beverage such as beer. A pressure pouch 20 may also be located within the container 12 as shown. Pressure pouch 20 may be of the type which contains various compartments housing components of a two-part gas generating system.

The liquid 16 may be a nitrogenized liquid and may, for example, be beer having nitrogen gas dissolved therein at a concentration of from about 30 to about 50 PPM. The nitrogenized beer may also, for example, have carbon dioxide gas dissolved therein at a concentration of from about 2 to about 15 PPM.

In operation, the pressure pouch 20 serves to apply pressure to the liquid 16 located within the container 12. Accordingly, the liquid 16, located within the container 12, is maintained at a pressure higher than that of the atmosphere located on the exterior 22 of the container 12. Thus, a user may activate the improved dispensing valve assembly 200 to cause a portion of the liquid 16 to be dispensed through the opening 62. As liquid is dispensed from the container 12, the pressure pouch 20 will expand, eventually causing a further compartment or compartments within the pouch 20 to open and thereby release an additional quantity of reactive component. In this manner, the pouch 20 is able to maintain the interior of the container 12 at a substantially constant pressure.

The container 12 is an example of a relatively low pressure dispensing system as previously described and may, for example, maintain the liquid 16 at a pressure of between about 15 and about 25 psi and, more preferably at a pressure of about 20 psi. With the exception of the improved dispensing valve assembly 200, as will be described in further detail herein, the dispensing system 10 may, for example, be configured as described in any of U.S. Pat. Nos. 4,919,310; 4,923,095; U.S. Pat. Nos. 5,333,763; and 5,769,282 as previously referenced.

Figure 2:
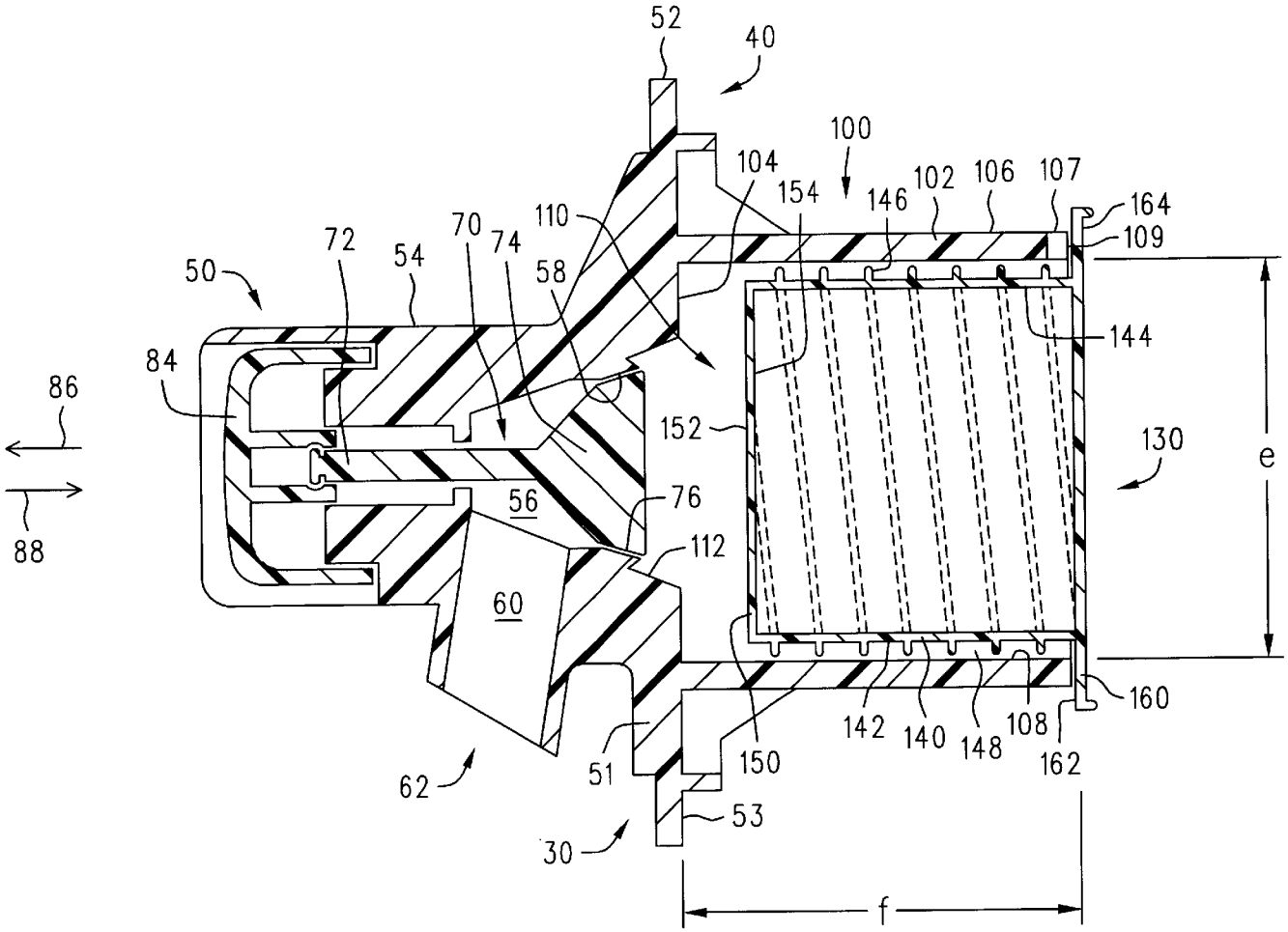
FIG. 2 (PRIOR ART)
FIG. 2 is a side cross sectional elevational view of a prior art dispensing valve assembly.
Figure 3:
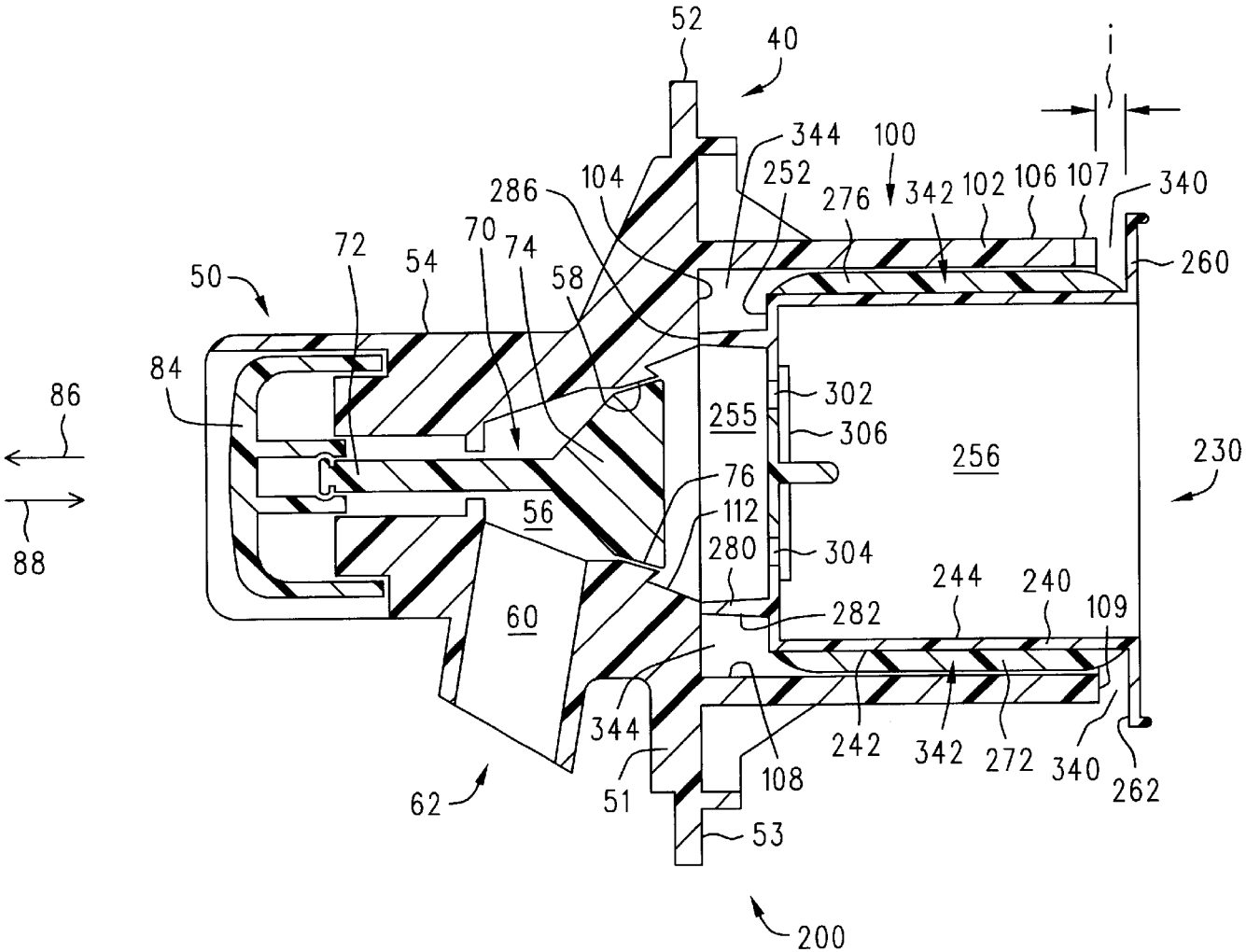
FIG. 3 is a side cross sectional elevational view of the improved dispensing valve assembly of FIG. 1 and illustrating in further detail an improved insert member installed within a valve body.

FIG. 3 illustrates the improved dispensing valve assembly 200 in further detail. FIG. 2 illustrates a prior art dispensing valve assembly 30. For purposes of the description presented herein, the "front" of the dispensing valve assembly is the end of the assembly proximate the button 84, FIG. 3, which extends externally of the container 12 when the assembly is attached to the container in a manner as illustrated in FIG. 1. The "rear" of the dispensing valve assembly is the end of the assembly which is proximate the rear surface 162 and which extends into the interior of the container 12 when the assembly is attached to the container. Further, the term "rearwardly" refers to a direction extending toward the rear of the assembly, i.e., the direction 88 in FIG. 3. The term "forwardly" refers to the opposite direction which extends toward the front of the assembly, i.e., the direction 86 in FIG. 3. The above terms are defined for illustration purposes only.

Referring first to FIG. 2, prior art dispensing valve assembly 30 may include a valve body 40. Valve body 40 generally includes a forward portion 50 and a rear portion 100 as shown. Forward portion 50 may include a circular wall member 51 having a flange portion 52 located at the radially outer edge thereof. A substantially flat rearwardly facing annular surface 53 may be formed on the rearward side of the flange portion 52 as shown. A forwardly projecting portion 54 may extend forwardly from the wall member 51 as shown. A chamber 56 may be enclosed by the forward portion 50. A generally annular tapered valve seat surface 58 may be formed at the rearward end of the chamber 56. The chamber 56 may be in fluid communication with a passage 60. The passage 60 terminates in the opening 62.

A valve member 70 may be located within the valve body forward portion 50 as shown in FIG. 2. Valve member 70 may include a forward stem portion 72 and a flared rearward portion 74. The flared rearward portion 74 may include a generally annular tapered sealing surface 76 which sealingly engages the valve seat surface 58 when the valve assembly 30 is in its closed position, as illustrated in FIG. 2. IA resilient button 84 may be attached to the front end of the stem portion 72 such that it exerts a forward force on the valve member 70, i.e., a force in the direction indicated by the arrow 86 in FIG. 2. In this manner, the resilient button 84 biases the valve to its closed position by forcing the valve member tapered sealing surface 76 tightly against the tapered valve seat surface 58.

Valve body rear portion 100 may include an annular wall portion 102 which extends rearwardly from the rear surface 104 of the circular wall member 51. Annular wall portion 102 includes a generally cylindrical outer surface 106, a generally cylindrical inner surface 108 and a generally annular rear surface 109. An opening 107 may be formed through the annular wall portion 102 as shown, extending between the outer surface 106 and the inner surface 108. A chamber 110 is bounded by the annular wall portion inner surface 108 and the circular wall member rear surface 104.

The inner surface 108 of the annular portion 102 may have a diameter "e" of about 1.5 inches as shown in FIG. 2. A distance "f" of about 1.375 inches may extend between the rear portion rear surface 104 and the rear surface 109 of the annular wall portion 102.

Chamber 56 terminates in a generally circular opening 112 formed in the circular wall member rear surface 104, thus establishing fluid communication between the forward portion chamber 56 and the rear portion chamber 110.

Referring again to FIG. 2, an insert member 130 may be housed within the valve body chamber 110. Insert member 130 may include an annular wall portion 140 having a generally cylindrical outer surface 142 and an oppositely disposed generally cylindrical inner surface 144. A helical rib 146 ay be integrally formed on the outer surface 142 of the annular wall portion 140 as shown. Insert member 130 may further include a generally circular bottom wall portion 150 integrally formed with the annular wall portion 140. Bottom wall portion 150 may include a forwardly facing surface 152 and a rearwardly facing surface 154. An annular flange 160 may be integrally formed on the insert member 130 opposite the bottom wall portion 150. Flange 160 may include a forwardly facing surface 162 and a rearwardly facing surface 164.

Valve body 40 may, for example, be integrally formed from a plastic material such as polypropylene. Valve member 70 may, for example, be integrally formed from a plastic material such as polyethylene. Insert member 130 may, for example, be integrally formed from a plastic material such as polypropylene. Valve body 40, valve member 70 and insert member 130 may, for example, be formed by any conventional process, such as an injection molding process. Button 84 may, for example, be integrally formed from an elastomeric material such as polyurethane. Button 84 may, for example, be formed by any conventional process such as an injection molding process.

When the insert member 130 is installed within the chamber 110, as shown in FIG. 2, the insert member flange forwardly facing surface 162 may abut the annular wall portion rear surface 109 as shown. The helical rib 146 of the insert member 130 may also frictionally engage the inner surface 108 of the annular wall portion 102. The insert member 130 may be held in place within the chamber 110 via this frictional engagement between the helical rib 146 and the inner surface 108. As can be appreciated, a generally helical fluid flow passage 148 will be formed between the surfaces 108 and 142 and the adjacent portions of the helical rib 146.

When the dispensing valve assembly 30 is inserted into the opening of a dispensing container (such as the opening 14 in the container 12, FIG. 1), rear surface 53 of the flange portion 52 will abut the container opening. The dispensing valve assembly 30 may then be securely fastened to the container, for example, with a crimp ring in a conventional manner. Fastened in this manner, the rear portion 100 of the valve assembly 30 will be located within the container and, thus, exposed to the pressurized liquid to be dispensed therefrom. The forward portion 50 of the valve assembly 30 will be located on the exterior 22 of the container.

To dispense liquid using the dispensing valve assembly 30, a user depresses the button 84, i.e., in the direction indicated by the arrow 88 in FIG. 2. This movement, in turn, causes the attached valve member 70 to move in the same direction thus unseating the valve member sealing surface 76 from the valve seat surface 58. When the valve member is moved to its open position in this manner, liquid contained within the container will begin to flow out through the dispensing opening 62 of the dispensing valve assembly 30. Specifically, the pressurized liquid within the container will first pass through the opening 107, thus entering the rearward end of the fluid flow passage 148. Thereafter, the liquid will travel along the helical passage 148 until it exits into the space generally located between the insert member forwardly facing surface 152 and the rear portion rear surface 104. From this space, the liquid will next enter the chamber 56 through the opening 112, passing over the open valve member flared rearward portion 74. From the chamber 56, the liquid will then travel through the passage 60 and exit the system through the opening 62 where it may be dispensed, for example, into a cup or glass for consumption.

The dispensing valve assembly 30 described above, and specifically the insert member 130, is typically used for dispensing carbonated beverages that do not contain dissolved nitrogen. The helical passage 148, in particular, is provided in order to gently reduce the pressure of the liquid from the system pressure existing within the container to the atomospheric pressure existing outside of the container. Such a gentle reduction in pressure is necessary when dispensing highly carbonated beverages, such as most non-nitro beers or soft drinks, in order to prevent excess foaming and outgassing when the beverage is dispensed.

As described previously, however, when dispensing nitro beers, it is desirable to force the nitrogen out of solution in order to achieve the desirable creamy head of foam and lacing characteristics associated with nitro beers. It has been found that, although the dispensing valve assembly 30 described above works very well for dispensing non-nitro beers and soft drinks, it will not force a sufficient amount of nitrogen out of solution when dispensing a nitro beer.

As previously described, it is known to provide through holes (e.g., having a cross-sectional area of about 0.00062 square inch) in relatively high pressure (i.e., between about 30 and about 40 psi) nitro beer dispensing systems in order to force nitrogen out of solution and properly dispense nitro beers. It has been found, however, that conventional through holes of this size will not function adequately in a relatively low pressure nitro beer dispensing system, as previously defined. Specifically, such holes fail to force a sufficient amount of nitrogen out of solution in a relatively low pressure system and, thus, fail to induce the desirable creamy head and lacing characteristics of nitro beer as previously described.

Applicants have discovered that a relationship exists between the degree of gas liberation, the amount of nitrogen gas dissolved in the nitro beer, the pressure of the dispensing system and the size of the holes through which the nitro beer is forced during dispensing. Specifically, gas liberation tends to increase with higher levels of dissolved nitrogen. Gas liberation also tends to increase with higher dispensing system pressures. Finally, gas liberation tends to increase as the size of the individual openings through which the nitro beer is forced during dispensing is reduced. Based upon the above, applicants have determined that, if the openings through which the nitro beer is forced during dispensing are reconfigured, then nitro beers may properly be dispensed even in a relatively low pressure dispensing system as described above. Specifically, applicants have discovered that if the holes are made significantly smaller than the conventional holes, then nitro beer may properly be dispensed, even in a relatively low-pressure dispensing system.

Applicants have successfully dispensed (i.e., sufficient gas liberation was achieved) nitro beers containing relatively high levels of dissolved nitrogen (i.e., over about 40 ppm) through a plurality of openings, each having cross-sectional area of about 0.00025 square inch, at a relatively low system pressure of as low as about 15 psi. Other nitro beers containing relatively low levels of dissolved nitrogen (i.e., less than about 40 ppm) could not be properly dispensed (i.e., insufficient gas liberation was not achieved) at this pressure range and opening size. These other nitro beers were, however, successfully dispensed through the same size openings at a slightly higher system pressure of as low as about 20 psi.

Accordingly, for the proper dispensing of at least some nitro beers from a relatively low pressure dispensing system, the holes or openings may be formed with each opening having a cross-sectional area of less than about 0.00030 square inch and more preferably less than about 0.00027 square inch and, most preferably about 0.00023 square inch. When such nitro beer is forced through these small openings, a sufficient amount of nitrogen will be forced out of solution, even in a relatively low-pressure system. Accordingly, the use of such reconfigured openings induces the desirable creamy head and lacing characteristics of nitro beer, as previously described, even when the nitro beer is dispensed from a relatively low pressure system. Applicants' discovery, thus, enables at least some nitro beers to properly be dispensed from a relatively low pressure dispensing system.

It has further been found that the surface finish of the hole may also impact the amount of gas which is liberated during dispensing. Specifically, the more rough or jagged the hole, the more gas is liberated. Accordingly, a relatively larger hole having a jagged or rough profile may liberate as much gas during dispensing as a relatively smaller hole having a smooth profile. It has been found, for example, that a jagged circular hole having a diameter of about 0.025 inch (and a resulting area of about 0.000491 square inch) will generally liberate about as much gas as a smooth circular hole having a diameter of about 0.018 inch (and a resulting area of about 0.000254 square inch).

Although it is known to provide through holes in nitro beer dispensing systems in order to force nitrogen out of solution, it has been found that such through holes are difficult and expensive to accurately manufacture due to the relatively small size of the holes and the relatively high degree of precision required. The difficulty and expense are magnified in a relatively low pressure system, as previously defined, since, in such a system, as described above, the holes must be made even smaller in order to accomplish the desired effect.

FIG. 3 illustrates, in further detail, the improved dispensing valve assembly 200. As will be explained in further detail, the improved dispensing valve assembly 200 overcomes the problems associated with the manufacturing of through holes as described above. Referring now to FIG. 3, the dispensing valve assembly 200 may include a valve body 40 and an improved insert member 230. The valve body 40 may, for example, be identical to the valve body 40 previously described with respect to FIG. 2. Accordingly, the valve body 40 depicted in FIG. 3 generally includes the same reference numerals used in FIG. 2 to refer to features of the valve body 40. The improved insert member 230, however, is substantially different from the insert member 130 described with respect to FIG. 2.

Figure 4:
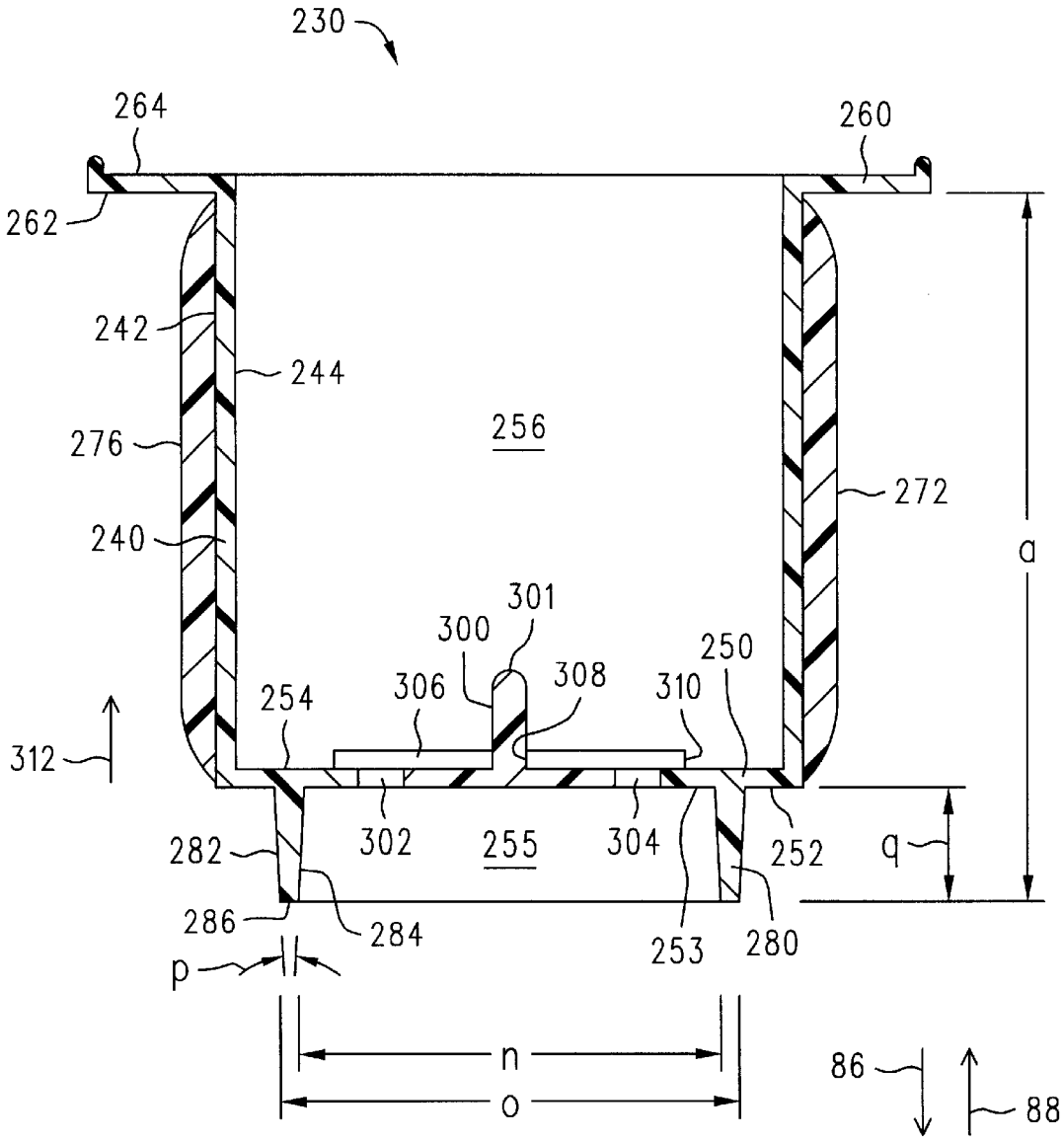
FIG. 4 is a side cross sectional elevational view of the improved insert member of FIG. 3, taken along the line 4—4 in FIG. 5.
Figure 5:
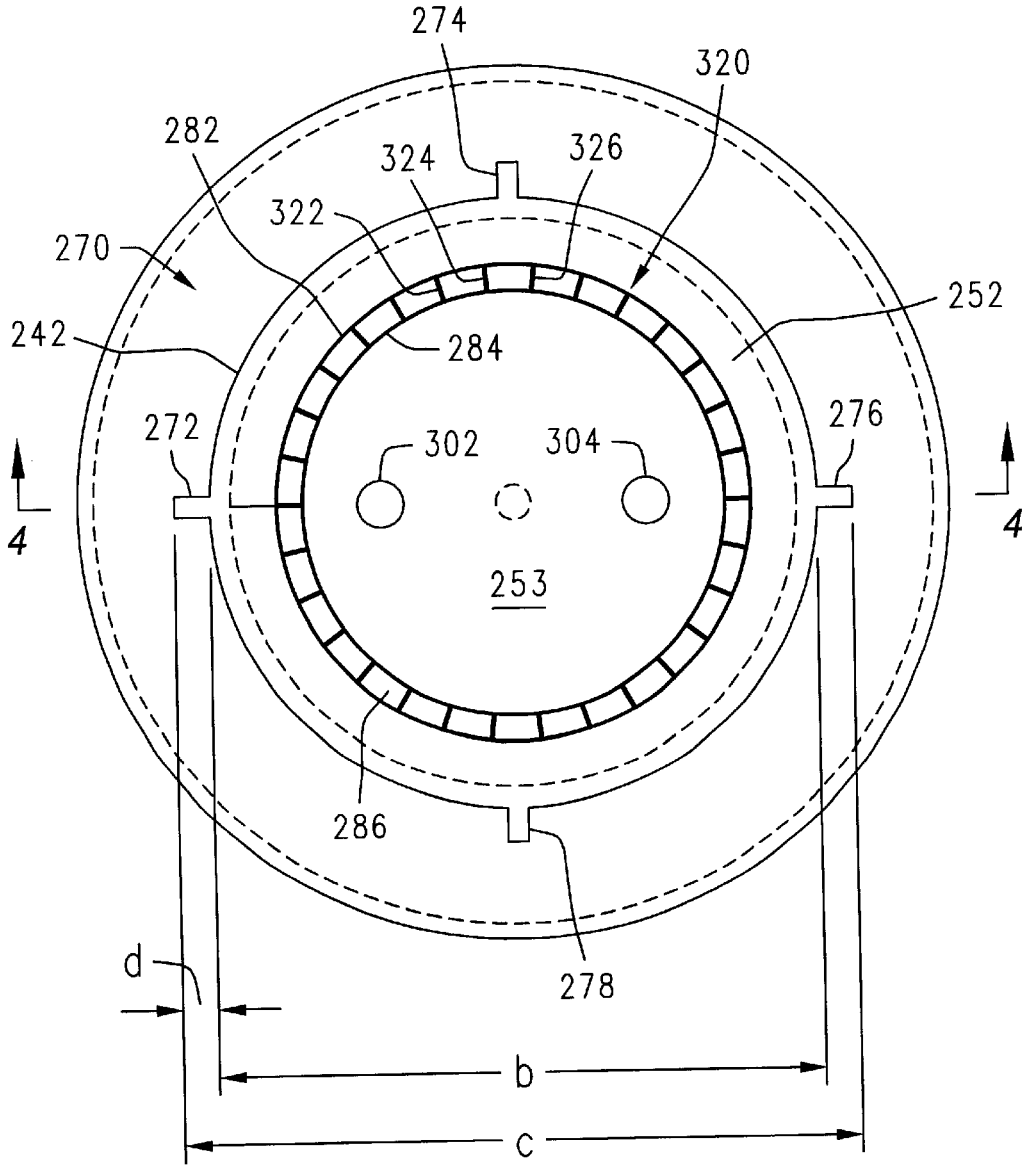
FIG. 5 is a bottom plan view of the improved insert member of FIG. 3.
Figure 6:
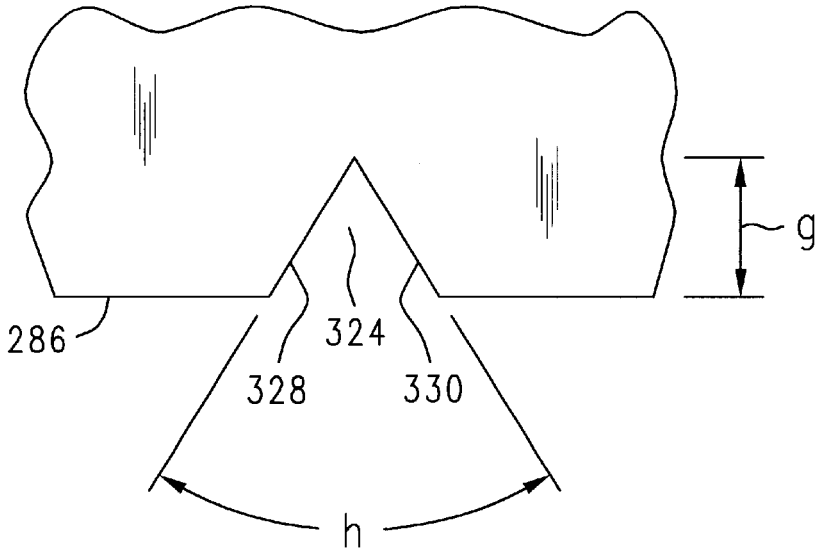
FIG. 6 is a detail view of a portion of the improved insert member of FIG. 3, illustrating a groove formed therein.

FIGS. 4–6 illustrate the improved insert member 230 in further detail. Turning first to FIG. 4, insert member 230 may include an annular wall portion 240 having a generally cylindrical outer surface 242 and an oppositely disposed generally cylindrical inner surface 244. Insert member 230 may further include a generally circular bottom wall portion 250, which may be integrally formed with the annular wall portion 240. Bottom wall portion 250 may include a forwardly facing surface 252 and a rearwardly facing surface 254. A chamber 256 is formed within the insert member 230 and is generally defined by the annular wall portion inner surface 244 and the bottom wall portion rearwardly facing surface 254.

An annular flange 260 may be integrally formed on the insert member 230 opposite the bottom wall portion 250. Flange 260 may include a forwardly facing surface 262 and a rearwardly facing surface 264.

Referring to FIGS. 4 and 5, a plurality of fins 270, e.g., the individual fins 272, 274, 276, 278, may extend outwardly from the outer surface 242 of the annular wall portion 240. The fins 270 may extend for substantially the entire length of the annular wall portion 240 and may be integrally formed therewith.

An annular wall portion 280 may extend forwardly from the forwardly facing surface 252 of the bottom wall portion 250 as shown in FIGS. 4 and 5. Annular wall portion 280 may be integrally formed with the bottom wall portion 250 and further may include a generally cylindrical outer surface 282 and an oppositely disposed generally cylindrical inner surface 284. Annular wall portion 280 may also include an annular forwardly facing surface 286 which extends between the outer and inner surfaces 282, 284. The intersection of the annular wall portion 280 and the bottom wall portion forwardly facing surface 252 defines therewithin an interior portion 253 of the forwardly facing surface 252. This interior portion 253, along with the inner surface 284 of the annular wall portion 280, generally define a chamber 255.

A stud member 300 may be integrally formed with the bottom wall portion 250 and may extend rearwardly from the rearwardly facing surface 254 of the bottom wall portion 250 as shown in FIG. 4. Stud member 300 may, for example, be generally cylindrical, having a diameter of about 0.090 inch. Stud member 300 may have a tapered portion 301 at the rearward end thereof. A pair of openings 302, 304 may be extend through the bottom wall portion 250 as shown. The openings 302, 304 may, for example, each be circular having a diameter of about 0.120 inch. A flap member 306 may be provided as shown. Flap member 306 may, for example, be formed from a resilient material such as a food grade silicone rubber. Flap member 306 may include a central opening 308 which may, for example, be circular having a diameter of about 0.060 inch. The outer perimeter 310 of the flap member 306 may, for example, be circular in shape having a diameter chosen so that the flap member 306 will entirely overlie the openings 302, 304 as illustrated in FIG. 4. Flap member 306 may have a thickness of from about 0.020 to about 0.030 inch.

The flap member 306 may be held in place on the stud 300, as shown in FIG. 4, due to the interference fit between the diameter of the stud 300 and the diameter of the flap member central opening 308. The tapered portion 301 of the stud 300 may be provided in order to facilitate installation of the flap member 306 onto the stud 300. As can be appreciated, the stud 300, flap member 306 and the holes 302, 304, together, form a one-way valve which will allow fluid flow to occur through the holes 302, 304 in the direction of the arrow 312 (i.e., in a direction from the chamber 255 into the chamber 256) but which will prevent fluid flow through the holes 302, 304 in the opposite direction (i.e., in a direction from the chamber 256 into the chamber 255).

Referring again to FIG. 4, insert member 230 may have a height "a" of about 1.5 inches, extending between the lower surface 262 of the annular flange 260 and the forwardly facing surface 286 of the annular wall portion 280. Annular wall portion 280 may have a height "q" of about 0.20 inch extending between the surface 252 and the surface 286. Referring to FIG. 5, the outer surface 242 of the annular wall portion 240 may have a diameter "b" of about 1.26 inches. A distance "c" of about 1.515 inches may extend between each set of opposing fins 270. Accordingly, each of the fins 270 may extend for a distance "d" of about 0.1275 inch from the outer surface 242 of the annular wall portion 240.

Referring to FIG. 5, the forwardly facing surface 286 may be provided with a plurality of generally radially extending grooves 320, such as the individual grooves 322, 324 and 326. The surface 286 may, for example be provided with thirty grooves. FIG. 6 illustrates, in further detail, the groove 324, as viewed in a plane perpendicular to the groove, which may be exemplary of all of the grooves 270. As can be appreciated from FIG. 6, the groove 324 may have the cross-sectional shape of a triangle having a height "g" and an included angle "h". Groove 324 may, for example, have the cross sectional shape of an equilateral triangle as shown in FIG. 6. As can be appreciated, when the groove 324 is formed having the cross-sectional shape of a triangle, then the groove is at least partially bounded by the surfaces 328, 330 which are formed in the insert member annular wall portion 280.

Referring again to FIG. 4, the annular wall portion inner surface 284 may have a diameter "n" at its forward edge, i.e., at a location adjacent the surface 286.

Annular wall portion outer surface 282 may have a diameter "o" at its forward edge, i.e., at a location adjacent the surface 286. The diameter "n" may, for example, be about 0.90 inch and the diameter "o" may, for example, be about 1.02 inches. Accordingly, given these exemplary dimensions, the surface 286 may have a radial extent of about 0.060 inch (one-half the difference between "n" and "o"). As can be appreciated, each of the grooves 320, as previously described, will have a length approximately equal to this radial extent of the surface 286, i.e., about 0.060 inch. Annular wall portion 280 may include a draft angle "p" of about 2.5 degrees, as illustrated in FIG. 4. Accordingly, the radial thickness of the annular wall portion 280 may be greater at a rearward portion, e.g., adjacent the lower surface 253, than it is at a forward location, e.g., adjacent the surface 286. This draft angle "p" may be provided to facilitate removal of the insert member 230 from the mold when the insert member is formed in an injection molding process as described previously. Providing a draft angle in the vicinity of the annular wall portion 280 is particularly important since it is critical that the grooves 320, which are formed in the annular wall portion 280, be accurately formed.

Insert member 230 may, for example, be integrally formed from a plastic material such as polypropylene. Insert member 230 may, for example, be formed by any conventional process, such as an injection molding process.

FIG. 3 illustrates the insert member 230 installed within the valve body 40. Installed in this manner, the insert member forwardly facing surface 286 will abut the valve body rear surface 104, as shown. The height "a", FIG. 4, of the insert 230 may be chosen to be larger than the height "f", FIG. 2, of the valve body 40, such that an annular gap 340, having a width "i", FIG. 3, is formed between the valve body rear surface 109 and the insert member annular flange forwardly facing surface 262 as shown. As can be appreciated, the width "i" will be equal to the difference between the dimension "a", FIG. 4, of the insert 230 and the dimension "f", FIG. 2, of the valve body annular wall portion 102. As previously described, the height "a" may be about 1.5 inches and the height "f" may be about 1.375 inches. Accordingly, based upon these exemplary dimensions, the width "i" of the annular gap 330 may, for example, be about 0.125 inch.

The insert member 230 may be held in place within the rear portion 100 of the valve body 40 via frictional engagement between the insert member fins 270 (only the fins 272 and 276 are shown in FIG. 3) and the inner surface 108 of the valve body annular wall portion 102. In addition to holding the insert member 230 within the valve body 40, the fins 270 serve to maintain a generally annular space 342 between the insert member outer surface 242 and the valve body annular wall portion inner surface 108. A further, generally annular space 344 is defined generally between the valve body surfaces 104 and 108, and the insert member surfaces 252 and 282.

Figure 7:
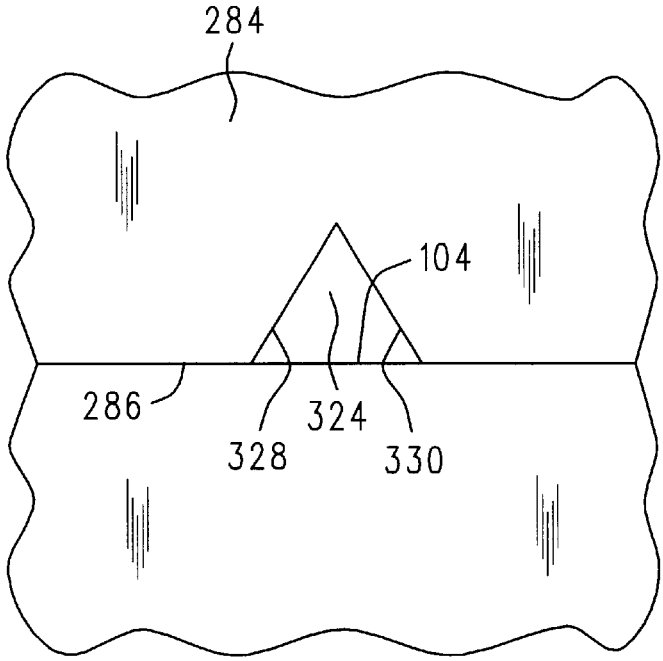
FIG. 7 is a detail view of the improved insert member groove of FIG. 6 when the improved insert member is install thin the valve body as illustrated in FIG. 3.

With the insert member 230 installed in this manner, the insert member forwardly facing surface 286 will be tightly engaged against the valve body rear surface 104. This tight engagement is facilitated by the pressure within the dispensing system 10, FIG. 1, when the dispensing assembly 200 is installed therewithin, as will be described in further detail. Fluid communication, however, is established between the space 344 and the chamber 255 via the grooves 270 provided in the insert member annular wall portion 280. FIG. 7 illustrates, in detail, one of the grooves 270 when the insert member surface 286 is tightly engaged with the valve body surface 104.

As shown in FIG. 7, the groove 324 has now become an enclosed passage which is bounded by the insert member surfaces 328, 330 and the valve body surface 104. Accordingly, the groove is defined by portions of both the insert member 230 and the valve body 40. As will be described in further detail herein, this arrangement allows very small openings, i.e., the grooves 270, to be easily manufactured. These small openings, in turn, serve to force nitrogen out of solution when a nitrogenized liquid, such as nitro beer, is dispensed through the assembly.

When the dispensing valve assembly 200 is inserted into the opening of a dispensing container, as illustrated in FIG. 1, rear surface 53 of the flange portion 52 will abut the container opening. The dispensing valve assembly 200 may then be securely fastened to the container, for example, with a crimp ring in a conventional manner. Fastened in this manner, the rear portion 100 of the valve assembly 200 will be located within the container and, thus, exposed to the pressurized liquid to be dispensed therefrom. The forward portion 50 of the valve assembly 30 will be located on the exterior 22 of the container 12.

To dispense liquid using the dispensing valve assembly 200, a user depresses the button 84, i.e., in the direction indicated by the arrow 88 in FIG. 3. This movement, in turn, causes the attached valve member 70 to move in the same direction, thus unseating the valve member sealing surface 76 from the valve seat surface 58. When the valve member is moved to its open position in this manner, liquid contained within the container 12, FIG. 1, will begin to flow out through the dispensing opening 62 of the dispensing valve assembly 30. Specifically, the pressurized liquid 16 within the container 12 will first enter the annular space 342 via the gap 340. Thereafter, the liquid will enter the space 344. From the space 344, the liquid will be forced through the small radial passageways extending between the space 344 and the chamber 255. As previously described, these small passageways are defined by the interaction between the insert member grooves 270 and the valve body surface 104.

From the chamber 255, the liquid will next enter the chamber 56 through the opening 112, passing over the open valve member flared rearward portion 74. From the chamber 56, the liquid will then travel through the passage 60 and exit the system through the opening 62 where it may be dispensed, for example, into a cup or glass for consumption.

When liquid is being dispensed from the dispensing valve assembly 200, in a manner as described above, a pressure differential will exist between the chamber 256 and the chamber 255, FIG. 3. Specifically, liquid in the chamber 256 will be at substantially the same pressure as the liquid in the interior of the container 12, FIG. 1. The liquid in chamber 256 will, thus, be at a higher pressure than the liquid in the chamber 255. This causes a pressure drop across the insert member bottom wall portion 250, FIG. 4, which, in turn, causes the insert member 230 to be urged in the forward direction 86, FIG. 3, relative to the valve body 40. This force causes the insert member forwardly facing surface 286 to be tightly engaged with the valve body rear surface 104 as previously described. This tight engagement, in turn, prevents liquid from flowing between the insert member forwardly facing surface 286 and the valve body rear surface 104 and, thus, bypassing or partially bypassing the grooves 270.

It is noted that the opening 107 is illustrated in FIG. 3 as being part of the improved dispensing valve assembly 200. As previously described, the opening 107 serves to allow liquid to enter the helical fluid flow passage 148 in the prior art dispensing valve assembly 30, FIG. 2. In the improved dispensing valve assembly 200, however, the gap 340, as previously described, serves to allow pressurized liquid 16, FIG. 1, to enter the space 342. Accordingly, although the opening 107 may be provided, it is not necessary for proper operation of the improved dispensing valve assembly 200.

Referring to FIG. 1, after the dispensing assembly 200 is attached to the container 12, it is sometimes necessary to activate or "trigger" the pressure pouch 20. U.S. Pat. No. 5,337,763, previously referenced herein, describes a triggering apparatus and method in which pressure is supplied to the pouch from a source external to the container in order to accomplish this triggering. Specifically, a source of pressurized gas may be attached to the opening 62. The valve member 70 may then be held in the open position to allow the pressurized gas to enter the container and activate the pouch.

In the prior system illustrated in FIG. 2, such pressurized gas is able to travel along the helical fluid flow passage 148 in order to reach the interior of the container. In the improved dispensing assembly 200, e.g., FIGS. 3–7, however, it has been found that the grooves 320 are too small to allow a sufficient quantity of pressurized gas to pass in a sufficient amount of time. As a result, applying triggering pressure to the improved dispensing assembly 200 tends to force the insert member 230 rearwardly relative to the valve body 40.

To overcome this problem, a one way valve assembly (i.e., the stud 300, flap member 306 and the holes 302, 304, FIGS. 3 and 4) may be provided in a manner as previously described. Specifically, when pressurized gas is applied through the opening 62 of the improved dispensing valve assembly 200, the gas may pass through the holes 302, 304 to reach the interior of the container 12, thus bypassing the grooves 320. During normal dispensing operation of the system 10, however, the flap member 306 will cover and seal the openings 302, 304, thus causing the liquid dispensed from the container 12 to pass through the grooves 320. Accordingly, the one way valve assembly (i.e., the stud 300, flap member 306 and the holes 302, 304) forces liquid dispensed from the system 10 to pass through the grooves 320, thus forcing nitrogen out of solution, but also allows the pouch 20 to be triggered by pressurized gas.

It is noted that the one way valve assembly described above may be omitted if the improved dispensing assembly 200 is used in conjunction with a system which does not use a pressure pouch or if it is used in conjunction with a pressure pouch of a type which does not require externally supplied gas pressure for activation.

The improved dispensing valve assembly 200 described above has been found to work well when dispensing nitro beers. Specifically, the small radial passageways defined by the interaction between the insert member grooves 270 and the valve body surface 104 serve to force nitrogen out of solution in order to achieve the desirable creamy head of foam and lacing characteristics associated with nitro beers.

The dispensing valve assembly 200 has been described herein in conjunction with a relatively low pressure dispensing system 10, FIG. 1, as previously defined. As previously described, it has been discovered that at least some nitro beers may be properly dispensed from such a relatively low-pressure system if the nitro beer is forced through openings having very small cross-sectional areas, as previously defined. Accordingly, when used in conjunction with a relatively low pressure system, the grooves 320, such as the groove 324 illustrated in FIG. 6, may be formed having a height "g" and an angle "h" chosen to achieve the desired cross sectional area. The height "g" may, for example, be about 0.01 inch and the angle "h" about 60 degrees. This configuration results in each of the grooves 320 having a cross-sectional area of about 0.000058 square inch. As described above, openings of this size have been found to work well with relatively low-pressure nitro beer dispensing systems.

The flow rate of liquid through the dispensing assembly may be controlled by varying the number of grooves 320 provided in the insert member 230. It has been found that providing thirty grooves, sized as described above, provides an adequate flow rate in a relatively low pressure system. Specifically, the flow rate provided by this number of grooves is between about 1.0 and about 1.5 ounces per second at a system pressure of about 20 psi.

Although the dispensing valve assembly 200 has been described herein in conjunction with a relatively low pressure dispensing system, it could readily also be used with a relatively high-pressure system. Dispensing valve assembly 200 could, for example, be used in conjunction with a dispensing system having a pressure of between about 30 and about 40 psi. When used in conjunction with such a system, the grooves 320 may, for example, be provided with each having a cross sectional area of about 0.00062 inch. To accomplish this, the height "g" and the angle "h" of the grooves 320 may be appropriately chosen. The number of grooves may also be appropriately chosen to achieve the desired flow rate.

The improved dispensing system 200 is more easily manufactured relative to prior nitro beer dispensing systems. As previously described, such prior systems typically use through holes to force nitrogen out of solution. Such through holes are difficult to manufacture and, due to their relatively small size, generally must be formed by a machining operation. Such machining is expensive and time consuming and further has been found to pose additional problems when the through holes are to be formed in plastic, rather than metal, parts. Specifically, it has been found that it is difficult to accurately machine very small through holes in plastic parts due to the propensity of the plastic material to creep. These problems are magnified when smaller holes, for use in conjunction with a relatively low pressure dispensing system, are required.

The improved dispensing system 200 overcomes these problems by substituting openings, each of which is defined by two separate parts. Specifically, the openings may be defined by both the insert member grooves 320, e.g., the groove 324, and the valve body surface 104 as illustrated in FIG. 7. The grooves 320 may be easily molded into the insert member 230 when the insert member is molded. The insert member may, for example, be molded in a conventional injection molding process. The mold used to form the insert member may be provided with raised portions corresponding in size, shape and location to the location of the desired grooves 320. In this manner, the grooves may be accurately formed in a rapid and efficient manner, at the same time that the insert is formed and the need for subsequent machining steps is avoided.

In this manner, the insert member 230 and grooves 320 may be formed in a single manufacturing step. In addition, the size of the grooves may readily and accurately be controlled.

The grooves 320 have been illustrated herein as being triangular in cross section. Although this shape is desirable from an ease of manufacturing standpoint, other shapes could, alternately be used.

Figure 8:
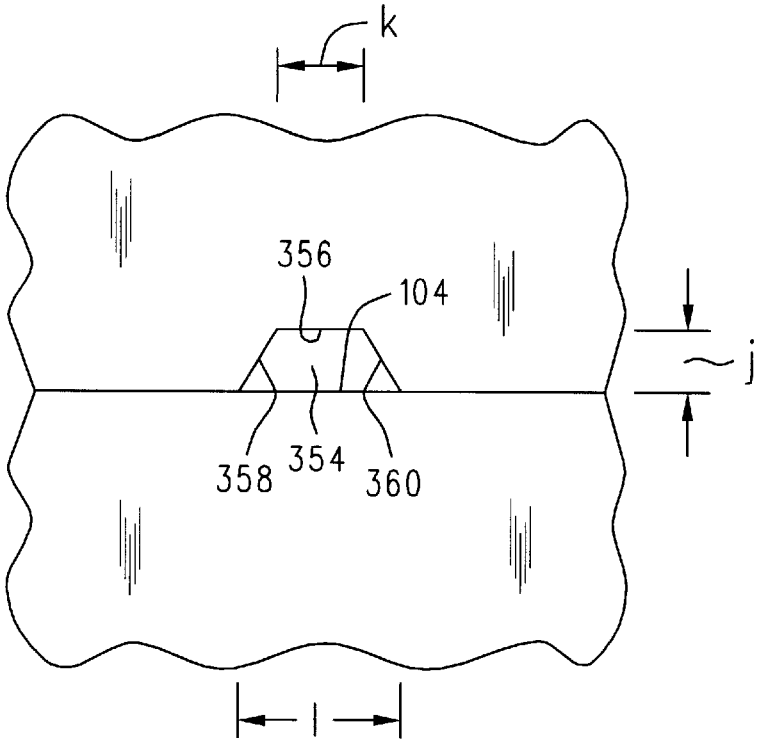
FIG. 8 is an alternative embodiment of the groove illustrated in FIG. 7, when the improved insert member is installed within the valve body.

FIG. 8, for example, illustrates a groove 354 having the cross-sectional shape of a trapezoid. Groove 354 may have an upper surface 356, an oppositely disposed substantially parallel surface formed by the surface 104 and two opposite non-parallel side surfaces 358, 360. Groove 354 may, for example, have a height "j" extending between the surfaces 356 and 104, a minimum width "k" extending between the surfaces 358, 360 at the surface 356 and a maximum width "l" extending between the surfaces 358, 360 at the surface 104. As can be appreciated, the dimensions "j", "k" and "l" may readily be chosen to accommodate any desired cross-sectional area.

Figure 9:
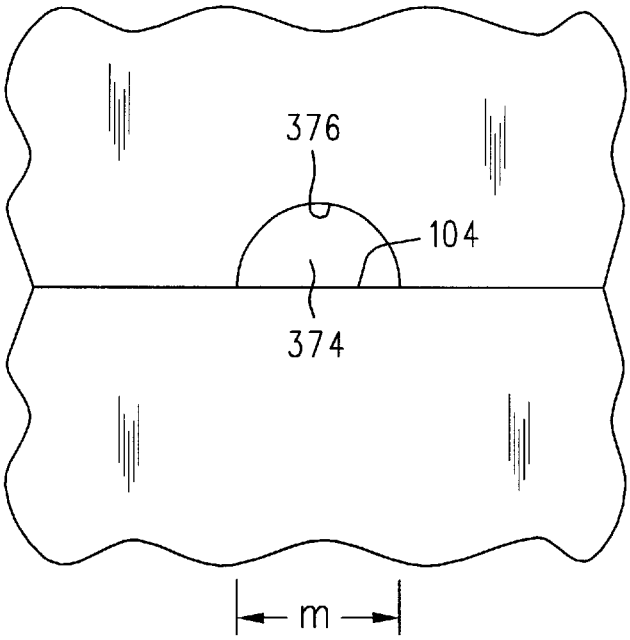
FIG. 9 is a further alternative embodiment of the groove illustrated in FIG. 7, when the improved insert member is installed within the valve body.

FIG. 9 illustrates a groove 374 having an arcuate surface 376. The groove 374 may, for example, be formed as a semi-circle having a diameter "m". As can be appreciated, the diameter "m" may readily be chosen to accommodate any desired cross-sectional area.

It is noted that, although various exemplary cross-sectional shapes for the grooves have been described herein, any other shape could alternatively been used.

It is further noted that the preceding description has focused primarily on the dispensing of beer for exemplary purposes only. The reduced hole size and the configuration for forming holes could also readily be used in conjunction with the dispensing of other types of liquids containing dissolved gas, such as cider, soft drinks and sparkling wine.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A dispensing system for dispensing a liquid having a gas dissolved therein, said dispensing system comprising:

a) a liquid flow path through said dispensing system;

b) a first member having a plurality of grooves formed therein;

c) a second member;

d) at least a portion of said first member in abutting relationship with at least a portion of said second member;

e) a plurality of openings, each of said openings being defined at least partially by one of said plurality of grooves and at least a portion of said second member;

f) a pressure pouch located therein; and wherein at least a portion of said liquid flow path extends through said plurality of openings.

2. The dispensing system of claim 1 wherein said at least a portion of said second member comprises a surface formed on said second member.

3. The dispensing system of claim 1 wherein said pressure pouch is in contact with said liquid.

4. The dispensing system of claim 1 wherein said pressure pouch contains components of an at least two component gas generating system.

5. The dispensing system of claim 1 wherein said gas is nitrogen.

6. The dispensing system of claim 1 wherein said liquid is beer.

7. The dispensing system of claim 1 and further including a one-way valve formed in said first member.

8. A dispensing system for dispensing a liquid having a gas dissolved therein, said dispensing system comprising:

a) a quantity of said liquid having a gas dissolved therein;

b) a liquid flow path through said dispensing system;

c) a first member having a plurality of grooves formed therein;

d) a second member;

e) at least a portion of said first member in abutting relationship with at least a portion of said second member;

f) a plurality of openings, each of said openings being defined at least partially by one of said plurality of grooves and at least a portion of said second member;

wherein at least a portion of said liquid flow path extends through said plurality of openings.

9. The dispensing system of claim 8 wherein said at least a portion of said second member comprises a surface formed on said second member.

10. The dispensing system of claim 8 and further including a pressure pouch located therein.

11. The dispensing system of claim 10 wherein said pressure pouch is in contact with said liquid.

12. The dispensing system of claim 10 wherein said pressure pouch contains components of an at least two component gas generating system.

13. The dispensing system of claim 8 wherein said gas is nitrogen.

14. The dispensing system of claim 8 wherein said liquid is beer.

15. The dispensing system of claim 8 and further including a one-way valve formed in said first member.

16. The dispensing system of claim 8 wherein said liquid flow path is in fluid communication with said quantity of liquid having a gas dissolved therein.

17. The dispensing system of claim 8 wherein said liquid flow path extends between said quantity of liquid having a gas dissolved therein and a point external to said dispensing system.

18. A method of dispensing liquid having a gas dissolved therein from a dispensing system, said method comprising:

providing a quantity of said liquid having a gas dissolved therein within said dispensing system;

providing a liquid flow path through said dispensing system;

providing a plurality of radial openings within said liquid flow path;

moving said liquid having a gas dissolved therein through said plurality of radial openings in a radially inward direction.

19. The method of claim 18 and further including providing a pressure pouch within said dispensing system and using said pressure pouch to perform said moving said liquid having a gas dissolved therein through said plurality of radial openings in a radially inward direction.

20. The method of claim 19 wherein said pressure pouch contains components of an at least two component gas generating system.

21. The method of claim 19 and further including:

providing a one-way valve within said dispensing system; and activating said pressure pouch by forcing a gas through said one-way valve.

22. The method of claim 18 wherein said gas is nitrogen.

23. The method of claim 18 wherein said liquid is beer.

24. The method of claim 18 and further comprising:

causing at least a portion of said gas to come out of solution by said moving said liquid having a gas dissolved therein through said plurality of radial openings in a radially inward direction.

* * * * *

UNITED STATES PATENT AND TRADEMARK OFFICE

CERTIFICATE OF CORRECTION

PATENT NO. : 6,247,614 B1
DATED : June 19, 2001
INVENTOR(S) : Whitney et al.

It is certified that error appears in the above-identified patent and that said Letters Patent is hereby corrected as shown below:

Column 2,
Line 22, after "achieved." begin a new paragraph

Column 3,
Line 50, delete "install" and insert therefor -- installed --
Line 51, delete "thin" and insert therefor -- within --

Column 6,
Line 2, delete "IA" and insert therefor -- A --

Column 10,
Line 52, after "286." do not begin a new paragraph

Signed and Sealed this

Twenty-sixth Day of March, 2002

*Attest:*

*Attesting Officer*

JAMES E. ROGAN
*Director of the United States Patent and Trademark Office*